United States Patent [19]

Burk, Jr. et al.

[11] 4,097,244

[45] Jun. 27, 1978

[54] PROCESS FOR REMOVING SULFUR FROM COAL

[75] Inventors: Emmett H. Burk, Jr., Glenwood; Jin S. Yoo, South Holland; John A. Karch, Chicago, all of Ill.

[73] Assignee: Atlantic Richfield Company, Philadelphia, Pa.

[21] Appl. No.: 749,952

[22] Filed: Dec. 13, 1976

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 3,454,363 | 7/1969 | Rieve | 201/17 X |
| 3,824,084 | 7/1974 | Dillon et al. | 44/1 R |
| 3,993,455 | 11/1976 | Reggel et al. | 44/1 R |
| 3,993,456 | 11/1976 | Cole et al. | 44/1 R |

*Primary Examiner*—Carl F. Dees

*Attorney, Agent, or Firm*—John B. Goodman

[57] ABSTRACT

A process for reducing the sulfur content of coal comprising the steps of:

1. contacting coal particles with an aqueous solution of iron complexing agent, and an oxidant to preferentially oxidize at least a portion of the sulfur in the coal;
2. thermally treating the oxidized sulfur-containing coal at elevated temperature to reduce the sulfur content of the coal; and
3. recovering coal particles of reduced sulfur content.

33 Claims, No Drawings

PROCESS FOR REMOVING SULFUR FROM COAL

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes (substituted, terminal and sandwiched forms) chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coals are known to be rich in pyritic and organic sulfur. Generally, the pyritic sulfur represents from about 25 to 70% of the total sulfur content in these coals.

Heretofore, it was recognized that it would be highly desirable to remove (or at least lower) the sulfur content of coal prior to combustion. In this regard, a number of processes have been suggested for reducing the inorganic (pyritic) portion of the sulfur in coal.

For example, it is known that at least some pyritic sulfur can be physically removed from coal by grinding the coal, and subjecting the ground coal to froth flotation or washing processes. While such processes can desirably remove some pyritic sulfur and ash from the coal, these processes are not fully satisfactory because a significant portion of the pyritic sulfur is not removed. Attempts to increase the portion of pyritic sulfur removed have not been successful because these processes are not sufficiently selective. Because the process is not sufficiently selective, attempts to increase pyrite removal can result in a large portion of coal being discarded along with ash and pyrite. Organic sulfur cannot be physically removed from coal.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3+FeS_2 \rightarrow 3FeCl_2+S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal. In addition, this process is notably deficient in that it cannot remove organic sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2+H_20+7/20_2 \rightarrow FeSO_4+H_2SO_4$$

$$2FeSO_4+H_2SO_4+1/20_2 \rightarrow Fe_2(SO_4)_3+H_2O$$

These reaction equations indicate that in this particular process the pyritic sulfur content continues to be associated with the iron as sulfate. While it apparently does not always occur, a disadvantage of this is that insoluble material, basic ferric sulfate, can be formed. When this occurs, a discrete separate separation procedure must be employed to remove this solid material from the coal solids to adequately reduce sulfur content. Several other factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount and/or heating value of the coal recovered from the process is decreased. The patent makes no claim that the process can remove organic sulfur from coal.

Numerous other methods have been proposed for reducing the pyritic sulfur content of coal. For example, U.S. Pat. No. 3,938,966, to Kindig et al issued Feb. 17, 1976, discloses treating coal with iron carbonyl to enhance the magnetic susceptibility of iron pyrites to permit removal with magnets. This process is clearly directed to removing only pyritic sulfur from coal.

While there are disadvantages associated with the prior art processes for removing pyritic sulfur from coal, the prior art process can provide a significant reduction in pyritic sulfur. A notable deficiency of these prior processes is that they do not provide a significant reduction in the organic sulfur content of coal. Organic sulfur can often represent a significant portion of the total sulfur content of coal.

A more effective method for reducing the sulfur content of coal would involve effectively reducing both the pyritic sulfur and organic sulfur content of coal.

In summary, while the problem of reducing the sulfur content of coal has received much attention, there still exists a present need for a practical method to more effectively reduce the sulfur content of coal.

SUMMARY OF THE INVENTION

This invention provides a practical method for more effectively reducing the sulfur content of coal. In summary, this invention involves a process for reducing the sulfur content of coal comprising the steps of:

1. contacting coal particles with an aqueous solution of iron complexing agent and an oxidant to preferentially oxidize at least a portion of the sulfur in the coal;
2. thermally treating the oxidized sulfur-containing coal at elevated temperature to reduce the sulfur content of the coal; and
3. recovering coal particles of reduced sulfur content.

In has been discovered that contacting sulfur-containing coal with an aqueous solution containing an iron complexing agent and an oxidant provides rapid oxidation of sulfur (reducing processing time) and more selective oxidation of sulfur compounds. In the course of this oxidation, pyritic sulfur can be removed. It has further been found that when this oxidized sulfur-containing coal is subjected to thermal treatment that substantial removal of remaining pyritic sulfur is obtained and significant organic sulfur removal is obtained. A process is, therefore, provided which can reduce both the pryritic and organic sulfur content of coal.

DETAILED DESCRIPTION OF THE INVENTION AND ITS PREFERRED EMBODIMENTS

In its broad aspect, this invention provides a method for reducing the sulfur content of coal by a process comprising the steps of:

1. contacting coal particles with an aqueous solution of iron complexing agent and an oxidant to preferentially oxidize at least a portion of the sulfur in the coal;
2. thermally treating the oxidized sulfur-containing coal at elevated temperature to reduce the sulfur content of the coal; and
3. recovering coal particles of reduced sulfur content.

The novel process of this invention can substantially reduce the pyritic sulfur content of coal. A notable advantage of the process is that it can also provide a reduction in the organic sulfur content of coal.

Suitable coals which can be employed in the process of this invention include brown coal, lignite, subbituminous, bituminous (high volatile, medium volatile, and low volatile), semi-anthracite, and anthracite. Regardless of the rank of the feed coal, excellent pyritic and organic sulfur removal can be achieved by the process of this invention. Metallurgical coals, and coals which can be processed to metallurgical coals, containing sulfur in too high a content, can be particularly benefited by the process of this invention.

In the first step of the process of this invention, coal particles are contacted with an aqueous solution of iron complexing agent and an oxidant such that at least a portion of the sulfur in the coal is oxidized.

The coal particles employed in this invention can be provided by a variety of known processes, for example, grinding or crushing.

The particle size of the coal can vary over wide ranges. In general the particles should be sufficiently small to enhance contacting with the aqueous medium. For instance, the coal may have an average particle size of one-fourth inch in diameter or larger in some instances, and as small as minus 200 mesh (Tyler Screen) or smaller. The rate of sulfur removal is faster the smaller the particle, but this advantage must be weighed against problems associated with obtaining and handling small particles. A very suitable particle size is often minus 5 mesh, preferably minus 18 mesh on 100 mesh as less effort is required for grinding and handling and yet the particles are sufficiently small to achieve an effective rate of sulfur removal.

The coal particles can be contacted with the aqueous solution of iron complexing agent by forming a mixture of the solution and coal particles. The mixture can be formed, for example, by grinding coal in the presence of water and adding a suitable amount of iron complexing agent and oxidant or an aqueous solution of iron complexing agent and/or oxidant can be added to coal particles of a suitable size. Preferably, the mixture contains from about 5 to about 50%, by weight of the mixture, coal particles and more preferably from about 10 to about 30%, by weight of the mixture, coal particles.

The iron complexing agents promote selective oxidation and removal of sulfur, and do not have a significant adverse effect on the coal.

The most suitable amount of iron complexing agent employed depends upon the pyrite and ash content of the coal, and the complexing agent employed. A mole ratio of complexing agent to pyrite of from about 0.05 to 10, and preferably 1.0 to 6.0, can be suitably employed. It is generally convenient to employ aqueous solutions of iron complexing agent which are from about 0.05 to about 1.0 molar, preferably 0.05 to 0.3 molar with respect to iron complexing agent.

Suitable iron complexing agents for use in this invention are compounds which can complex ferrous and/or ferric ions. Preferred complexing agents are compounds which can form ferrous complexes or ferric complexes having a stability constant of $-\log K$ greater than 1, and preferably greater than 2.0.

Convenient compilations providing stability constants of many complexing agents for iron are Martell and Calvin, "Chemistry of the Metal Chelate Compounds", U.S. copyright 1952, and "Stability Constants of Metal-Ion Complexes," supplement No. 1, Special Publication No. 25, published by The Chemical Society, U.S. copyright 1971.

Examples of suitable iron complexing agents include the following: carboxylic acids and carboxylic acid salts, including hydroxy carboxylic acids and salts for example, oxalic acid, melonic acid, succinic acid, citric acid, tartaric acid, latic acid, gluconic acid, salicylic acid, and salts thereof; diols and polyols, for example, glycol, glycerine, butane-1,3 diol, mannitol, sorbitol, glucose, lactose, fructose and sucrose; amines, for example, ethylenediamine, for example, glycine, and asparagine and salts thereof; amino polycarboxylic acids and amino polycarboxylic acid salts, for example, N-hydroxyethyl-iminodiacetic acid, nitrolotriacetic acid, N,N-di (2-hydroxyethyl) glycine and N,N,N',N'-ethylene-diaminetetraacetic acid and salts thereof; phosphonic acids and phosphonic acid salts, for example, ethane-1-hydroxy-1, 1-diphosphonic acid; and condensed phosphates, for example, trimetaphosphoric acid, tripolyphosphoric acid and salts thereof. Especially suitable salt forms of iron complexing agents are the potassium, sodium and ammonium salts. Mixtures of complexing compounds can be very desirably employed.

As will be recognized by those skilled in the art, the stability of the ferrous and ferric complexes formed will often be affected by the pH of the aqueous medium. In such cases, it is contemplated that the pH will be such that a stability constant $-\log K$ greater than 1 is maintained and more preferably, the optimum iron complexing pH for the particular complexing agent will be maintained. For example, a pH of from about 4.0 to 7.0 is preferred when the complexing agent is oxalic acid, and its corresponding salts, for example, sodium, potassium and ammonium salts. The particular pH employed can also affect the salt form of the complexing agent employed, and such iron complexing salts are complexing agents within the scope of this invention.

Many of the complexing agents useful in the process of this invention can be very desirably formed in situ prior to or in the course of the process. For example, cellulosic materials can be oxidized to form a complex mixture of polyols, hydroxy carboxylic acids, carboxylic acids and corresponding acid salts which can provide a complexing solution meeting the requirements of this invention. (Any aqueous solution of complexing agents which complexes the iron in coal satisfies the requirements of this invention).

Oxalic acid salts, for example, sodium, potassium and ammonium oxalate are preferred complexing agents for use in the process of the invention in that they are effective complexing agents which are readily available and inexpensive.

Suitable oxidants for use in this invention are those oxidants which preferentially oxidize the sulfur contained in the coal rather than the carbon portion of the coal. By this is meant that the oxidation of sulfur atoms occurs without substantial oxidation of carbon atoms to form, for example, ketones, carboxyl acids or other carbonyl-containing compounds, carbon monoxide and carbon dioxide. This preferential oxidation, or selectivity is important if the heat content of the treated coal is to be substantially maintained.

Included among the oxidants which are useful herein are organic oxidants and inorganic oxidants.

The organic oxidants include by way of example hydrocarbon peroxides, hydrocarbon hydroperoxides and hydrocarbon peracids wherein the hydrocarbon radicals in general contain from about 1 to about 30 carbon atoms per active oxygen atom. With respect to the hydrocarbon peroxides and hydrocarbon hydroperoxides, it is particularly preferred that such hydrocarbon radical contain from about 4 to about 18 carbon atoms per active oxygen atom, i.e., per peroxide linkage, and more particularly from 4 to 16 carbon atoms per peroxide linkage. With respect to the hydrocarbon peracids, the hydrocarbon radical is defined as that radical which is attached to the carbonyl carbon and it is preferred that such hydrocarbon radical contain from 1 to about 12 carbon atoms, more preferably from 1 to about 8 carbon atoms, per active oxygen atom. It is contemplated within the scope of this invention that the organic oxidants can be prepared in situ.

Typical examples of organic oxidants are hydroxyheptyl peroxide, cyclohexanone peroxide, t-butyl peracetate, di-t-butyl diperphthalate, t-butyl-perbenzoate, methyl ethyl ketone peroxide, dicumyl peroxide, t-butyl hydroperoxide, di-t-butyl peroxide, pinane hydroperoxide, 2,5-dimethylhexane-2,5-dihydroperoxide, tetrahydronaphthalene hydroperoxide and cumene hydroperoxide as well as organic peracids, such as performic acid, peracetic acid, trichloroperacetic acid, perbenzoic acid and perphthalic acid.

Inorganic oxidants include by way of example, oxygen, singlet oxygen, ozone, peroxides and superoxides. Typical examples of inorganic peroxides are $H_2O_2$, $KMnO_4$, $KO_2$, $Na_2O_2$, and $Rb_2O_2$; typical examples of inorganic superoxides are $KO_2$, $RbO_2$, $CsO_2$, $Na_2SO_5$ and $Na_2S_2O_8$.

Oxygen is a preferred oxidant.

In general, the mole ratio of oxidant to sulfur is from about 0.5 to about 10 atoms of active (i.e., reduceable) oxygen per atom of sulfur. More or less oxidant could be employed, however. The most effective oxidation will generally occur when the mole ratio of oxidant pyritic sulfur is greater than about 4, for example, when 5 to 10, atoms of active oxygen per atom of sulfur are present.

The preferred oxidant, oxygen, can be present as pure oxygen gas or it can be mixed with other inert gases. For example, air or air enriched with oxygen can be suitably employed as a source of gaseous oxygen. Preferably, the gaseous oxygen is above atmospheric pressure, for example, pressures of from about 5 to 500 psig., preferably 25 to 400 psig., and more preferably from about 50 to 300 psig. If the oxygen is mixed with other gases, the partial pressure of oxygen is most suitably within the pressure ranges mentioned hereinbefore.

Elevated temperatures can be desirably employed to accelerate the oxidation of sulfur. For example, temperatures of from about 150° to 500° F., preferably from about 150° to 400° F., and more preferably from about 175° to about 350° F., can be suitably employed. Under these reaction conditions, at least a portion of the sulfur in the coal (pyritic and organic sulfur) can be preferentially oxidized without significant adverse oxidation of the coal substrate.

The coal is held under these conditions for a period of time sufficient to preferentially oxidize at least a portion of the sulfur in the coal. The optimum time will depend upon the particular reaction conditions and the particular coal employed. Generally, a time period in the range of from about 5 minutes to 5 hours, or more, can be satisfactorily employed. Preferably, a time period of from 10 minutes to 2 hours is employed. During this time, it can be desirable to agitate the coal slurry. Known mechanical mixers, for example, can be employed to agitate the slurry.

The pyritic sulfur in coal can be oxidized under these conditions such that water soluble sulfur acids, for example, sulfuric acid, can be formed. If the pyritic sulfur content of the coal is high and a substantial amount of acid formed, it can often be necessary to add a basic material to obtain a desired pH. On the other hand, depending on the complexing agent, the character and content of ash in the coal, it may be necessary to add an acidic material to obtain a desired pH.

It will be recognized by those skilled in the art that there are many ways to obtain a desired pH range in the aqueous slurry. For example, the pH of the slurry can be monitored using commercially available pH meters, and a suitable quantity of basic or acidic material can be metered to the slurry as needed to maintain the desired buffered pH. Another suitable method for obtaining a pH in the desired range involves adding an appropriate amount of basic or acidic material to the aqueous slurry of coal and water prior to subjecting the slurry to the reaction conditions involving increased temperature and pressure.

Examples of suitable basic materials include alkali and alkaline earth metal hydroxides such as sodium hydroxide, potassium hydroxide, calcium hydroxide, magnesium hydroxide and their corresponding oxides. Other suitable basic materials include alkali and alkaline earth carbonates, such as sodium carbonate, sodium bicarbonate, potassium bicarbonate, ammonia, ammonium bicarbonate and ammonium carbonate. Among these basic materials, sodium hydroxide, sodium carbonate, sodium bicarbonate, potassium bicarbonate, ammonium bicarbonate and mixtures thereof are preferred.

An especially suitable acidic material is carbon dioxide.

Materials which are buffering agents can be a very useful aid in maintaining the desired pH. An example of a suitable buffering agent is sodium acetate. As oxidation of the pyritic sulfur proceeds to generate sulfuric acid, part of the sodium acetate is converted to acetic acid to yield a buffer mixture, sodium acetate and acetic acid, in situ in the reactor. Control of pH within a very narrow range can be achieved using such a buffering agent. Other buffering agents for maintaing a desired pH are known to those skilled in the art.

It will be recognized by those skilled in the art that many complexing agents suitable for use in the process of this invention are also buffering agents. For example, many carboxylic acid salts and aminocarboxylic acid salts can find use as both complexing agents and buffering agents in the process. (As will recognized by those skilled in the art, depending upon the pH such complexing/buffering agents will be present as a mixture of acid and salt forms). Oxalic acid salts, for example, sodium, potassium and ammonium oxalate are illustrative of preferred complexing/buffering agents employed in the process of this invention.

The most suitable basic materials for maintaining the pH of the aqueous solution in the process are those having cations which form soluble salts with sulfur-oxygen anions such as thiosulfate, sulfate and thionate. The most suitable basic materials have cations comprising sodium, ammonium and/or potassium since such materials are readily available and form water soluble materials with sulfate.

When coal particles are contacted with the aqueous solution of iron complexing agent and oxidant in the first step of this process, some sulfur (primarily pyritic sulfur) can be oxidized to form water soluble sulfur compounds, for example, water soluble sulfate salts. The results is that the sulfur content of the coal can often be diminished in the course of the first step of the process of this invention. If desired, substantially all of the pyritic sulfur can be removed from the coal in this first step. This is not always necessary, however, since substantial pyritic sulfur removal also occurs in the second step of the process.

In the second step of the process of this invention, the oxidized sulfur-containing coal is subjected to a thermal treatment. In the thermal treatment step, sulfur reduction is accomplished by heating the coal at an elevated temperature, preferably from about 500° F. to about 700° F., preferably in the absence of oxygen (or other oxidant), for a time sufficient to reduce the sulfur content of the coal, generally from about 10 minutes to 12 hours, preferably from about 20 minutes to 3 hours. In a preferred embodiment, the thermal treatment involves exposing the coal to superheated steam. In another preferred embodiment an aqueous slurry of the coal is heated to elevated temperature. The aqueous slurry of coal which can be employed in the thermal treatment step can be comprised of widely varying amounts of coal and water. Generally, the aqueous slurry suitably contains from about 10 to 50% preferably from about 15 to 35%, by weight of the slurry, of coal.

The aqueous slurry employed in this second step can be the mixture of coal and aqueous solution employed in the first step of the process. Generally, however, it is preferred to separate the coal particles from the aqueous solution employed in the first step, and form an aqueous slurry for use in the second step by mixing together oxidized sulfur-containing coal particles from the first step with water.

In an especially preferred embodiment, the second step of the process of this invention involves subjecting the oxidized-sulfur containing coal to a base thermal treatment. In the base thermal treatment step, the coal in the thermal treatment step is exposed to a base, preferably an alkali or alkaline earth metal hydroxide. In the base thermal treatment step, a coal, preferably as an aqueous slurry of coal and base, or in the presence of steam containing base, is heated to a temperature, preferably of from about 500° F. to about 700° F., preferably in the absence of oxygen (or other oxidant) for a time sufficient to reduce the sulfur content of the coal, generally from about 10 minutes to 12 hours, preferably from about 30 minutes to 3 hours. The presence of base in the thermal treatment step is preferred in that it can enhance sulfur removal. In general, it is preferred to use an alkali metal hydroxide, preferably potassium or sodium hydroxide, although the alkaline earth metal hydroxides or oxides, for example, calcium hydroxide and calcium oxide; carbonates, for example, potassium and sodium carbonate and bicarbonate; and calcined dolomitic materials can be utilized. An amount of base should be employed which provides enhanced sulfur removal. The optimum amount will vary depending on the coal. In general, a suitable amount of base on a mole basis is at least about 2 moles base to 1 mole sulfur preferably from about 2 moles base to about 4 moles base to 1 mole sulfur. In general, the aqueous slurry should have a pH of from 7 to 14, and preferably a pH of from 8 to 12.

In the second step of this process, a substantial portion of any remaining pyritic sulfur in the coal is removed, and most notably organic sulfur removal is obtained. While the amount of organic sulfur removal can vary significantly from one coal to another, generally significant organic sulfur removal is obtained, for example, generally from about 10 to 60%, or more, by weight, of the organic sulfur can be removed. It should be noted that significant organic sulfur removal cannot generally be obtained employing the second step of the process of this invention alone.

In the first step of the process of this invention, a portion of the organic sulfur is apparently activated such that it becomes amenable to removal in the second step of the process.

It is clear that in this process, temperatures above the boiling point of water will involve pressures at least corresponding to the vapor pressure of water at the temperatures employed such that suitable pressure vessels, for example, autoclaves, are required. Selection of suitable pressure vessels can be made by those skilled in the art.

In the third step of the process of this invention, coal particles of reduced sulfur content are recovered. Recovery of the coal particles can involve a liquid-solids separation of the aqueous slurry from the second step of the process. Such a separation can be effected in a variety of ways. Filtering with bar sieves or screens, centrifuging or agglomeration of coal particles with oil can be employed to separate the coal solids and water. The resulting coal product has a substantially reduced sulfur content. Preferably, the coal is dried prior to use or storage.

The following specific examples are provided to more specifically illustrate the invention described herein.

EXAMPLE I

Illinois #6 coal was ground and screened to provide a quantity of coal having a particle size of 100 × 0 mesh. The feed coal had the following analysis:

| Percent by Weight | Dry Ash Free Basis |
|---|---|
| Sulfate sulfur | 0.07% |
| Pyritic sulfur | 1.29% |
| Organic sulfur | 2.55% |
| Total sulfur | 3.91% |

The coal was treated in the following manner to reduce the sulfur content.

First Step

The coal was treated in the following manner to preferentially oxidize at least a portion of the sulfur in the coal. 30 grams of this coal and 200 ml. of an aqueous solution of iron complexing agent (0.2M sodium oxalate) were charged to an autoclave forming a slurry. The autoclave was sealed and then heated to 250° F.; oxygen was then introduced to the autoclave and maintained at a pressure of 300 psig. $0_2$. The coal was held under these conditions for 1 hour. In the course of the reaction, additional sodium oxalate solution was added as needed to maintain a pH of from 4.0 to 5.5. The autoclave was then cooled and excess oxygen released. The contents of the autoclave were then filtered to separate the coal and the aqueous solution. The separated coal product was thoroughly washed with warm water.

Second Step

The coal was then subjected to a thermal treatment. About 25 grams of the oxidized sulfur-containing coal obtained in the first step and 100 ml. of water were charged to an autoclave. The autoclave was sealed and purged with nitrogen to exclude air. The coal was held under these conditions for 2 hours. The autoclave was cooled, and the contents were filtered to separate the coal and water. The coal was then dried. The recovered coal product had the following analysis:

| Percent by Weight | Dry Ash Free Basis |
|---|---|
| Sulfate sulfur | 0.00 |
| Pyritic sulfur | 0.00 |
| Organic sulfur | 2.03 |

-continued

| Percent by Weight | Dry Ash Free Basis |
|---|---|
| Total sulfur | 2.03 |

the sulfur content of the coal was significantly reduced: 100% of the pyritic sulfur was removed, and 20% of the organic sulfur was removed. (As used herein, organic sulfur includes any elemental sulfur present). The total sulfur content of the coal was reduced 48%. The recovered coal product is highly improved in that it has a lower sulfur and ash content.

EXAMPLES II–VII

In the following Examples II to VII, a quantity of Illinois #6 coal was ground and screened to provide a quantity of coal having a particle size of 100 × 0. This feed coal had the following sulfur analysis:

| Percent by Weight | Dry Ash Free Basis |
|---|---|
| Sulfate sulfur | 0.07% |
| Pyritic sulfur | 1.29% |
| Organic sulfur | 2.55% |
| Total sulfur | 3.91% |

This coal was divided into various portions and each of the several portions were then treated in the following manner to reduce the sulfur content.

First Step

Each of the portions of coal was treated in the following manner to preferentially oxidize a portion of the sulfur in the coal.

Thirty grams of the coal and 200 ml. of an aqueous solution of iron complexing agent (0.2M sodium oxalate) were charged to an autoclave forming a slurry. The autoclave was sealed and heated to 250° F.; oxygen was then introduced and maintained at a pressure of 300 psig. The coal was held under these conditions for 1 hour. During the course of the reaction, additional sodium binoxalate solution was added as needed to maintain a pH of from 4.0 to 5.5. The autoclave was then cooled and excess oxygen released. The contents of the autoclave were then filtered to separate the coal product and the aqueous solution. The filtered coal product was washed with warm water.

A substantial portion of the pyritic sulfur was removed from the coal in this first step.

Second Step

Each of the coal products from step one were then subjected to a base thermal treatment in the following manner:

A 25 gram sample of each coal product, 100 ml. of water, and the indicated amount of the indicated base were charged to an autoclave. The autoclave was sealed, and the contents of the autoclve were raised to the indicated temperature. The coal product was held under these conditions for the indicated time. The autoclave was then cooled, and the contents of the autoclave were filtered to separate the coal product. The filtered coal product was washed with warm water and dried. The various base materials and amounts employed, temperatures, times and sulfur reductions obtained are shown in Table I.

TABLE 1

| Example | Base Thermal Treatment Conditions | | | Percent Sulfur in Product* | | | | Percent Removal | | |
|---|---|---|---|---|---|---|---|---|---|---|
| | | | | Total | Sulfur Type | | | | | |
| | Base | Time | Temperature | S | Sulfate | Pyrite | Organic | Pyrite | Organic | Total |
| Feed Coal | — | — | — | 3.91 | 0.07 | 1.29 | 2.25 | — | — | — |
| II | $Na_2CO_3$, 10.6g | 1 hr. | 660° F. | 1.75 | 0.00 | 0.00 | 1.75 | 100 | 32 | 55 |
| III | $Ca(OH)_2$, 25.0g | 2 hrs. | 626° F. | 2.00 | 0.19 | 0.07 | 1.74 | 95 | 32 | 49 |
| IV | NaOH, 10g | 2 hrs. | 626° F. | 1.82 | 0.05 | 0.00 | 1.76 | 100 | 31 | 53 |
| V | $NaCHO_2$, 17.0g | 2 hrs. | 660° F. | 1.91 | 0.01 | 0.00 | 1.90 | 100 | 25 | 51 |
| VI | $Na_2CO_3$, 10.6g | 0.5 hr. | 660° F. | 1.85 | 0.00 | 0.00 | 1.85 | 100 | 37 | 53 |
| VII | NaOH, 2.0g | 2 hrs. | 626° F. | 1.77 | 0.01 | 0.00 | 1.76 | 100 | 31 | 55 |

*Dry Ash Free Basis

In Example 1, the second step involved an aqueous thermal treatment without the presence of an added base material. In the preceding examples, Examples II–VII, base was present in the second step to provide enhanced sulfur removal. As can be seen, in each of Examples II–VII, excellent pyritic and organic sulfur removal was obtained. (As used herein, organic sulfur includes any elemental sulfur present).

EXAMPLES VIII–XIII

In the following examples, several types of coal were treated to reduce their sulfur content. Each of the coals were treated as follows:

First Step

A 30 gram sample of the coal (100 × 0 mesh) and 200 ml of a 0.2M ammonium oxalate solution were charged to an autoclave. The autoclave was sealed and heated to 250° F. Oxygen was then introduced to the autoclave and maintained at a pressure of 300 psig. $O_2$. The coal was held under these conditions for 1 hour. In the course of the reaction, additional sodium binoxalate solution was added as needed to maintain a pH of from 4.5 to 5.0. The autoclave was then cooled and excess oxygen released. The contents of the autoclave were then filtered to separate the coal and the aqueous solution. The separated coal product was washed with warm water, and dried. A portion of the coal was analyzed to assess the sulfur reduction obtained in this first step.

Second Step

Each of the coal products from step one were then subjected to a base thermal treatment in the following manner. A 25 gram sample of coal product, 100 ml. of water and 6 grams of sodium carbonate were charged to an autoclave. The autoclave was sealed and purged with nitrogen to exclude air. The temperature of the contents of the autoclave was raised to 650° F. The coal was maintained under these conditions for 1 hour. The autoclave was then cooled, and the contents were filtered to separate the coal. The coal was then dried. The coal was then analyzed to determine the sulfur content.

The particular coals employed, the sulfur content of the coal (prior to treatment, after first step treatment and after second step treatment), and the percentage of sulfur removed are shown in Table II below. In that table, the abbreviation T.S. means total sulfur; S.S. means sulfate sulfur; P.S. means pyritic sulfur; and O.S. means organic sulfur as defined by coal industry recognized tests.

TABLE II

| Ex. | Coal Source | Percent Sulfur in Coal* | | | | Percent Removal | | |
|---|---|---|---|---|---|---|---|---|
| | | T.S. | S.S. | P.S. | O.S. | T.S. | P.S. | O.S. |
| VIII | Iowa, Mahaska County | 9.43 | 1.25 | 3.88 | 4.30 | | | |
| | First Step | 4.49 | 0.31 | 0.32 | 3.06 | 52 | 92 | 11 |
| | Second Step | 3.11 | 0.07 | 0.14 | 2.90 | 67 | 96 | 33 |
| IX | Middle Kittanning Armstrong Country, Pennsylvania | 6.81 | 0.43 | 4.11 | 2.27 | | | |
| | First Step | 2.36 | 0.10 | 0.09 | 2.17 | 65 | 98 | 4 |
| | Second Step | 1.50 | 0.13 | 0.01 | 1.36 | 78 | 100 | 40 |
| X | Clarion #4 Seam Meigs Center, Ohio | 5.48 | 0.13 | 2.06 | 2.49 | | | |
| | First Step | 2.41 | 0.06 | 0.42 | 1.19 | 56 | 85 | 23 |
| | Second Step | 1.50 | 0.01 | 0.03 | 1.41 | 73 | 99 | 41 |
| XI | Clarion #4 Seam Meigs Center, Ohio | 6.74 | 0.16 | 3.52 | 3.06 | | | |
| | First Step | 0.69 | 0.07 | 0.41 | 2.18 | 60 | 88 | 29 |
| | Second Step | 1.56 | | | 1.56 | 77 | 100 | 50 |
| XII | Pittsburgh, Warwick Mine #14 | 3.77 | 0.09 | 1.86 | 1.82 | | | |
| | First Step | 1.73 | 0.02 | 0.05 | 1.66 | 54 | 97 | 9 |
| | Second Step | | | | | 62 | 100 | 27 |
| XIII | Pittsburgh Seam, Alexander Mine | 5.63 | 0.11 | 2.38 | 3.11 | | | |
| | First Step | 3.27 | 0.11 | 0.12 | 3.04 | 42 | 95 | 2 |
| | Second Step | 2.46 | 0.01 | 0.01 | 2.24 | 56 | 100 | 28 |

*Dry Ash Free Basis

EXAMPLE XIV

When in Example I one of the following complexing agents is employed instead of sodium oxalate, the same or similar results are obtained in that the sulfur content of the coal is reduced: potassium oxalate, ammonium oxalate, sodium malonate, sodium glycinate, sodium ethylenediamine tetracetic acid, sodium N,N-di(2-hydroxyethyl)glycine, dextrose, ethylenediamine, and sodium tripolyphosphate.

EXAMPLE XV

When in Example I, First Step, the aqueous solution contains 0.2M. of an oxidant selected from the group consisting of peracetic acid, hydrogen peroxide or potassium superoxide instead of oxygen, the same or similar results are obtained in that sulfur content of the coal is reduced.

EXAMPLE XVI

In this example, the effectiveness of the two-step process of the invention is removing organic sulfur an a one-step process not employing a prior oxidation step is compared.

The feed coal employed was another batch of Illinois #6 coal crushed to a particle size of 100 × 0 mesh. The coal had the following sulfur analysis:

| Percent by weight | Dry Weight |
|---|---|
| Sulfate sulfur | 0.05 |
| Pyritic sulfur | 1.44 |
| Organic sulfur | 2.39 |
| Total sulfur | 3.88 |

Part A

Step 1

A 30 gram. portion of feed coal and 200 ml. of a 0.1M sodium oxalate solution were charged to an autoclave. The autoclave was sealed and heated to 300° F. Oxygen was then introduced to the autoclave and maintained at a pressure of 300 psig. $O_2$. The coal was held under these conditions for 1 hour. The initial pH was 7.6, in the course of the reaction the pH fell to 5.2. The autoclave was cooled and excess oxygen released. The contents of the autoclave were filtered to separate the coal and the aqueous solution. The separate coal product was washed with warm water, and dried. A portion of the coal was analyzed to assess the sulfur reduction obtained in this first step. The coal product had the following sulfur analysis:

| Percent by Weight | Dry Weight |
|---|---|
| Sulfate sulfur | 0.07 |
| Pyritic sulfur | 0.02 |
| Organic sulfur | 2.36 |
| Total sulfur | 2.45 |

The pyritic sulfur was reduced 99% by weight and practically no organic sulfur was removed.

Step 2

The coal product from step 1 was then subjected to the following base thermal treatment.

A 25 gram sample of the coal product, 100 ml. water, 10 grams NaOH and 3 grams ($Ca(OH)_2$ were charged to an autoclave. The autoclave was sealed and purged with nitrogen to exclude air. The temperature of the contents of the autoclave was raised 650° F. (1800 psig. steam pressure). The coal product was maintained under the conditions for 2 hours. The autoclave was cooled, and the contents filtered to separate the coal. The coal was then dried. The coal was then analyzed to determine the sulfur content. It was found that 39% organic sulfur, by weight based on feed coal, was removed. All remaining pyritic sulfur was removed.

Part B

The process presented in Part B is not an example of the invention but is presented for comparison purposes.

A 25 gram sample of Illinois #6 feed coal, 150 ml. water, 10 grams NaOH and 3 grams $Ca(OH)_2$ were charged to an autoclave. The autoclave was sealed and purged with nitrogen to exclude air. The temperature of the contents of the autoclave was raised to 630° F. (1800 psig. steam pressure). The coal was maintained under these conditions for 2 hours. The autoclave was then cooled and the contents filtered to separate the coal. The coal was dried and analyzed to determine the sulfur content. The result was that 100%, by weight, pyritic sulfur was removed, but no organic sulfur was removed.

As can be seen, a first oxidation step as required by the invention, significantly enhances organic sulfur removal.

In this example, as in the previous examples, organic sulfur would include any elemental sulfur present in the coal. This is because standard analytical techniques for sulfur analysis in coal were employed and such techniques provide this result.

What is claimed is:

1. A process for reducing the sulfur content of coal comprising the steps of:

1. contacting coal particles with an aqueous solution of iron complexing agent, and an oxidant to preferentially oxidize at least a portion of the sulfur in the coal;
2. thermally treating the oxidized sulfur-containing coal at elevated temperatures to reduce the sulfur content of the coal; and
3. recovering coal particles of reduced sulfur content.

2. The process of claim 1 wherein the aqueous solution of iron complexing agent is maintained at elevated temperature.

3. The process of claim 2 wherein the oxidant is oxygen.

4. The process of claim 3 wherein the oxygen is maintained at a pressure of from 5 to 500 psig.

5. The process of claim 4 wherein the aqueous solution of iron complexing agent is maintained at an elevated temperature from about 150° F. to 400° F.

6. The process of claim 5 wherein the iron complexing agent is present in a mole ratio of iron complexing agent to pyrite of 0.5 to 10.

7. The process of claim 6 wherein the iron complexing agent is a compound which forms ferrous or ferric complexes having a stability constant $-\log K$ of more than 1.

8. The process of claim 7 wherein the stability constant $-\log K$ is greater than 2.

9. The process of claim 8 wherein the pressure of oxygen is from about 25 to 400 psig.

10. The process of claim 9 wherein the pressure of oxygen is from about 50 to 300 psig.

11. The process of claim 10 wherein the temperature is from about 175° F. to 350° F.

12. The process of claim 11 wherein the complexing agent is selected from the group consisting of carboxylic acids, and hydroxy carboxylic acids and their salts, diols and polyols, amines, amino acids and amino acid salts, amino polycarboxylic acids and amino polycarboxylic acid salts, phosphonic acids and phosphonic acid salts, condensed phosphates, and salts of condensed phosphates.

13. The process of claim 12 wherein the salts are alkali metal and ammonium salts.

14. The process of claim 13 wherein the complexing agent is selected from the group consisting of sodium oxalate, potassium oxalate and ammonium oxalate.

15. The process of claim 2 wherein the oxidant is selected from the group consisting of ozone and singlet oxygen.

16. The process of claim 2 wherein the oxidant is an organic oxidant selected from the group consisting of hydrocarbon peroxides, hydrocarbon hydroperoxides and peracids.

17. The process of claim 2 wherein the oxidant is an inorganic oxidant selected from the group consisting of peroxides and superoxides.

18. The process of claim 1 wherein thermally treating the oxidized sulfur-containing coal at elevated temperature involves exposing the coal to steam.

19. The process of claim 1 wherein thermally treating the oxidized sulfur-containing coal involves heating an aqueous slurry of coal to elevated temperature.

20. The process of claim 17 wherein the oxidant is hydrogen peroxide.

21. A process for reducing the sulfur content of coal comprising the steps of:

1. contacting coal particles with an aqueous solution of iron complexing agent, and an oxidant to preferentially oxidize at least a portion of the sulfur in the coal;
2. subjecting the oxidized sulfur-containing coal to a base thermal treatment comprising heating an aqueous slurry of the coal and base to elevated temperature to reduce the sulfur content of the coal; and
3. recovering coal particles of reduced sulfur content.

22. The process of claim 19 wherein the aqueous solution of iron complexing agent is maintained at elevated temperature.

23. The process of claim 22 wherein the oxidant is oxygen.

24. The process of claim 23 wherein the oxygen is maintained at a pressure of from 5 to 500 psig.

25. The process of claim 24 wherein the aqueous solution of iron complexing agent is maintained at an elevated temperature from about 150° F. to 400° F.

26. The process of claim 25 wherein the iron complexing agent is present in a mole ratio of iron complexing agent to pyrite of 0.5 to 10.

27. The process of claim 26 wherein the iron complexing agent is a compound which forms ferrous or ferric complexes having a stability constant $-\log K$ of more than 1.

28. The process of claim 25 wherein the oxidant is hydrogen peroxide.

29. The process of claim 21 wherein the base is selected from the group consisting of alkali and alkaline earth metal hydroxides.

30. The process of claim 19 wherein the aqueous slurry has a pH of greater than 7.

31. The process of claim 21 wherein the base is selected from the group consisting of potassium hydroxide, sodium hydroxide, calcium hydroxide, potassium carbonate, sodium carbonate, calcium carbonate and calcium oxide.

32. The process of claim 1 wherein the recovered coal is metallurgical coal.

33. The process of claim 21 wherein the recovered coal is metallurgical coal.

* * * * *